US009211513B1

(12) United States Patent
Korpela

(10) Patent No.: US 9,211,513 B1
(45) Date of Patent: Dec. 15, 2015

(54) HANDHELD SHAKER ASSEMBLY

(71) Applicant: Daryl W. Korpela, Oconomowoc, WI (US)

(72) Inventor: Daryl W. Korpela, Oconomowoc, WI (US)

( * ) Notice: Subject to any disclaimer, the term of this patent is extended or adjusted under 35 U.S.C. 154(b) by 170 days.

(21) Appl. No.: 13/928,960

(22) Filed: Jun. 27, 2013

(51) Int. Cl.
*B01F 13/00* (2006.01)
*B01F 11/00* (2006.01)
*B01F 9/10* (2006.01)

(52) U.S. Cl.
CPC . *B01F 13/00* (2013.01); *B01F 9/10* (2013.01); *B01F 13/002* (2013.01); *B01F 2215/005* (2013.01)

(58) Field of Classification Search
CPC ..... B01F 13/002; B01F 9/10; B01F 2215/005
USPC ..... 366/212, 213, 218, 130, 129, 110, 113, 366/114, 128, 219, 605; 241/101.2
See application file for complete search history.

(56) References Cited

U.S. PATENT DOCUMENTS 1,242,218 A * 10/1917 McCann ..... 366/212
2,029,234 A * 1/1936 Helmes ..... 366/209
4,422,768 A 12/1983 Solomon
4,523,855 A 6/1985 Walker
D292,803 S 11/1987 Powell
4,893,938 A 1/1990 Anderson
5,273,357 A 12/1993 Currie
5,399,013 A 3/1995 Sawyer
5,451,105 A 9/1995 Koering
5,971,599 A 10/1999 Bothers
6,612,732 B2 9/2003 Blakeman, II et al.
6,719,451 B1 * 4/2004 Yue ..... 366/130
2011/0024537 A1 * 2/2011 Gonzalez ..... 241/101.2

* cited by examiner

*Primary Examiner* — Tony G Soohoo
*Assistant Examiner* — Anshu Bhatia

(57) ABSTRACT

A handheld shaker assembly for mixing a container of fluid includes a cylindrical holder that may insertably receive the container of fluid. A tubular housing is operationally coupled to the cylindrical holder. A motor is operationally coupled to the tubular housing. A primary gear is operationally coupled to the motor so the motor rotates the primary gear. A secondary gear is operationally coupled to the tubular housing. The secondary gear engages the primary gear so the primary gear rotates the secondary gear. A cam shaft is operationally coupled to the secondary gear so the secondary gear rotates the cam shaft. A first and second linkage are operationally coupled to the cam shaft so the cam shaft moves the first and second linkage. The second linkage engages the cylindrical holder so the second linkage moves the cylindrical holder. An actuator is coupled to the tubular housing to actuate the motor.

1 Claim, 5 Drawing Sheets

HANDHELD SHAKER ASSEMBLY

BACKGROUND OF THE DISCLOSURE

Field of the Disclosure

The disclosure relates to handheld shaker devices and more particularly pertains to a new handheld shaker device for mixing a container of fluid.

SUMMARY OF THE DISCLOSURE

An embodiment of the disclosure meets the needs presented above by generally comprising a cylindrical holder that may insertably receive a container of fluid. An upper cap is operationally coupled to the cylindrical holder so the container of fluid is retained in the cylindrical holder. A tubular housing is operationally coupled to the cylindrical holder so the tubular housing may be gripped by a user. A motor is operationally coupled to the tubular housing. A primary gear is operationally coupled to the motor so the motor rotates the primary gear. A secondary gear is operationally coupled to the tubular housing. The secondary gear engages the primary gear so the primary gear rotates the secondary gear. A cam shaft is operationally coupled to the secondary gear so the secondary gear rotates the cam shaft. A first linkage is operationally coupled to the cam shaft so the cam shaft moves the first linkage. A second linkage is operationally coupled to the first linkage so the first linkage moves the second linkage. The second linkage engages the cylindrical holder so the second linkage moves the cylindrical holder. The cylindrical holder mixes the container of fluid. An actuator is coupled to the tubular housing. The actuator is operationally coupled to the motor so the actuator selectively actuates the motor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
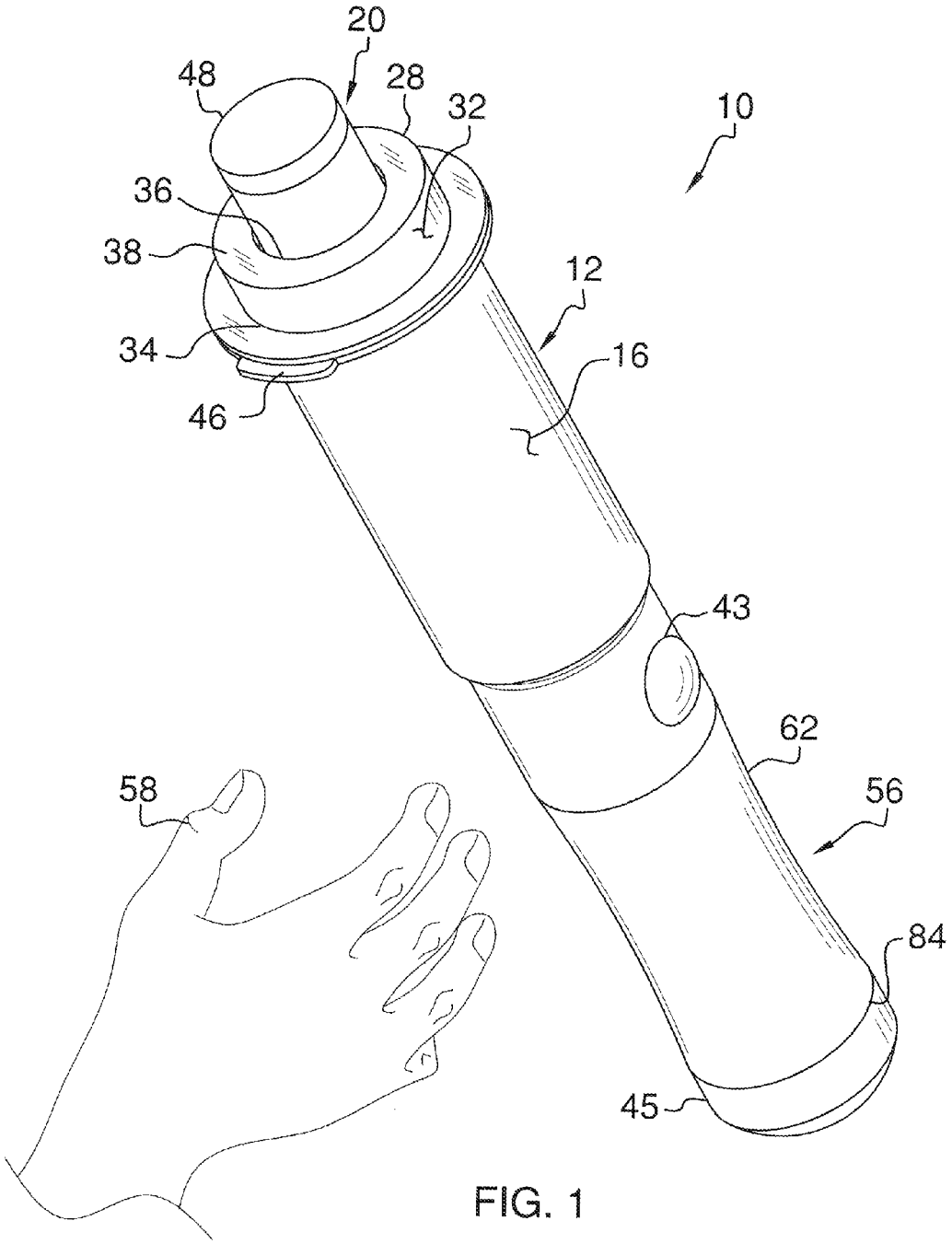
FIG. 1 is a perspective view of a handheld shaker assembly according to an embodiment of the disclosure.
Figure 2:
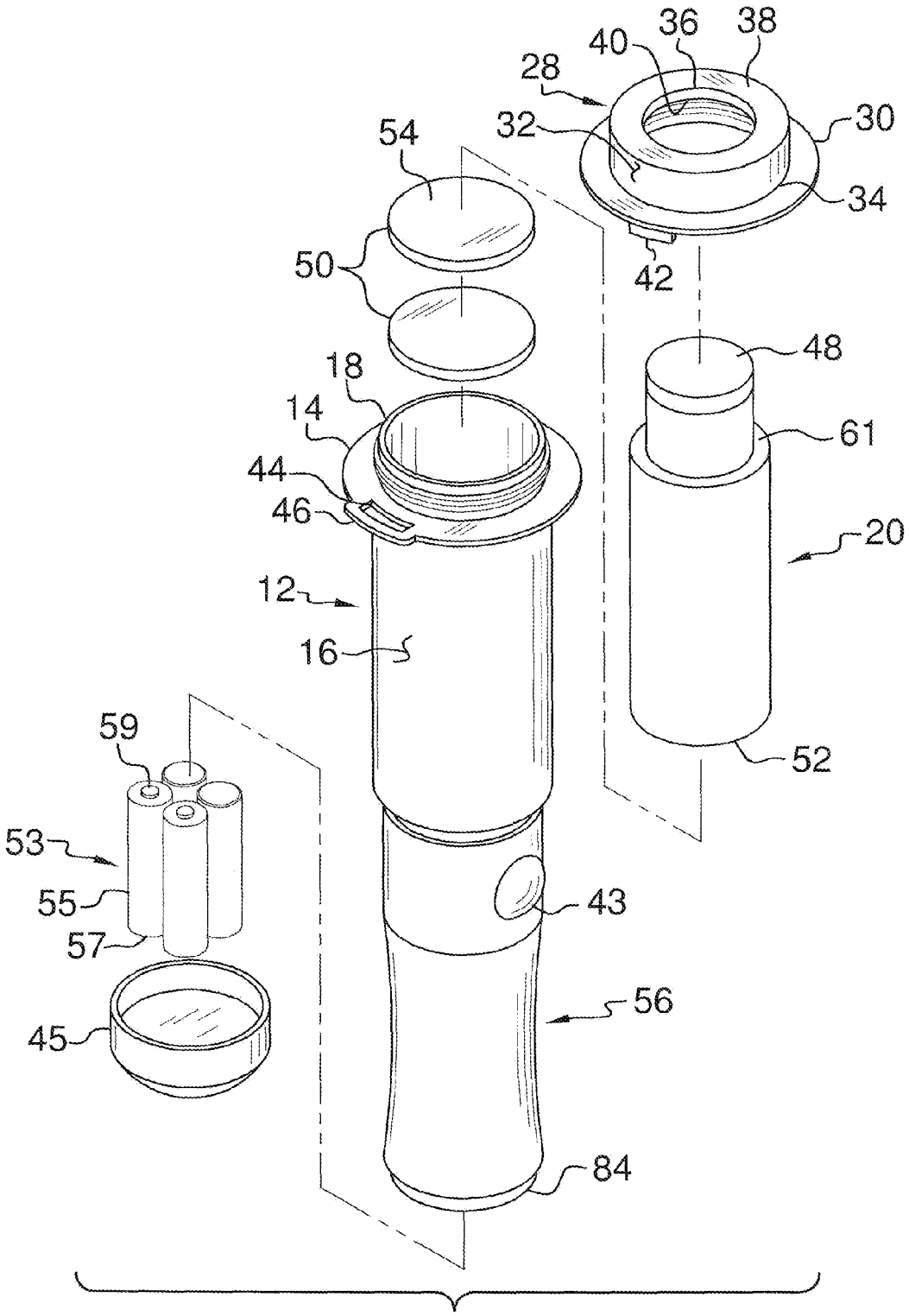
FIG. 2 is a top perspective view of an embodiment of the disclosure.
Figure 3:
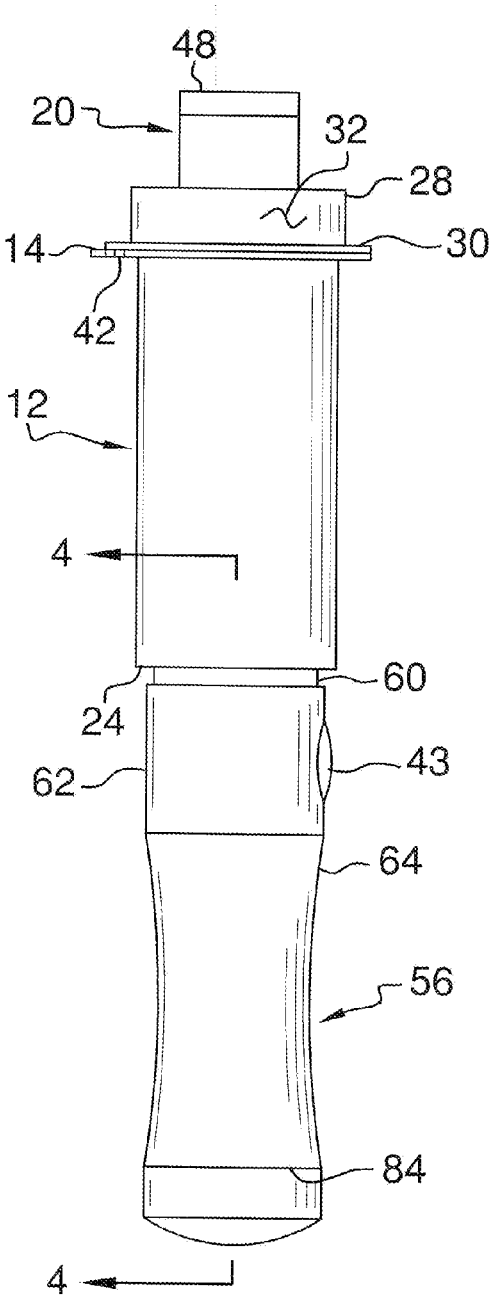
FIG. 3 is a right side view of an embodiment of the disclosure.
Figure 4:
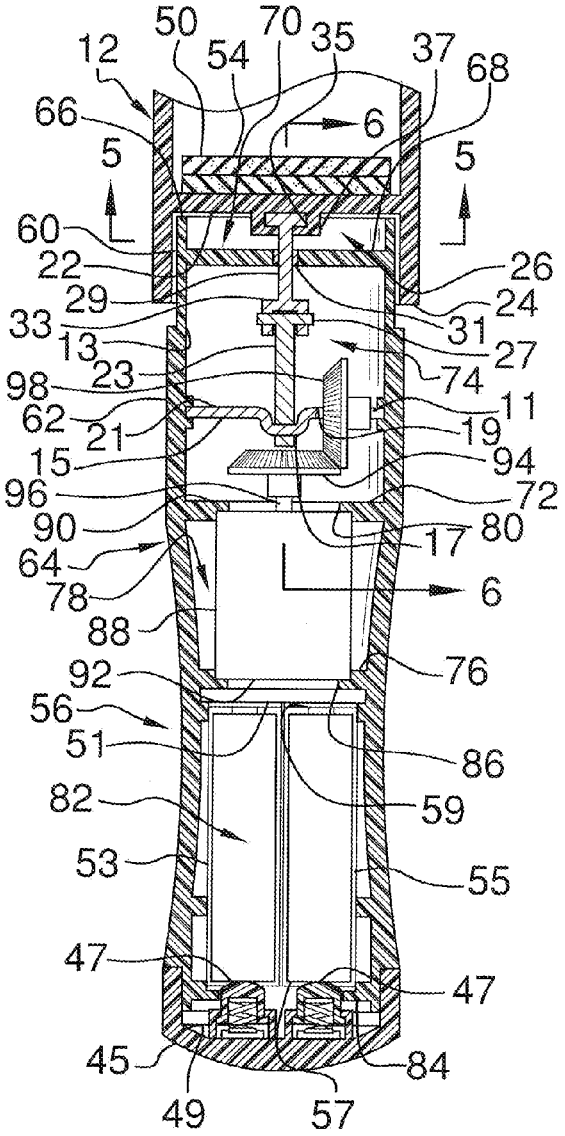
FIG. 4 is a cross sectional view taken along line 4-4 of FIG. 3 of an embodiment of the disclosure.
Figure 5:
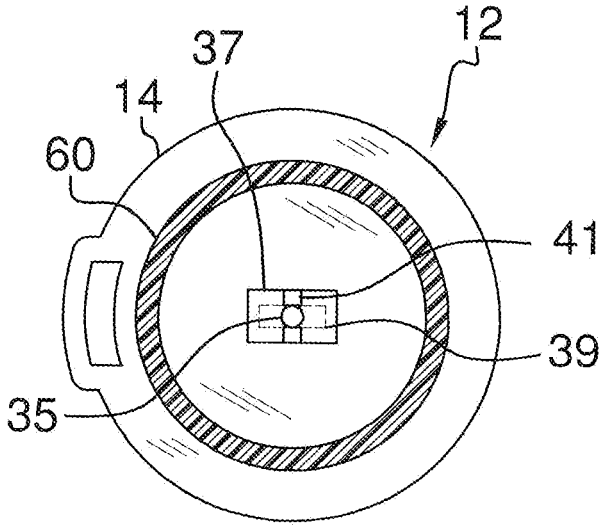
FIG. 5 is a cross sectional view taken along line 5-5 of FIG. 4 of an embodiment of the disclosure.
Figure 6:
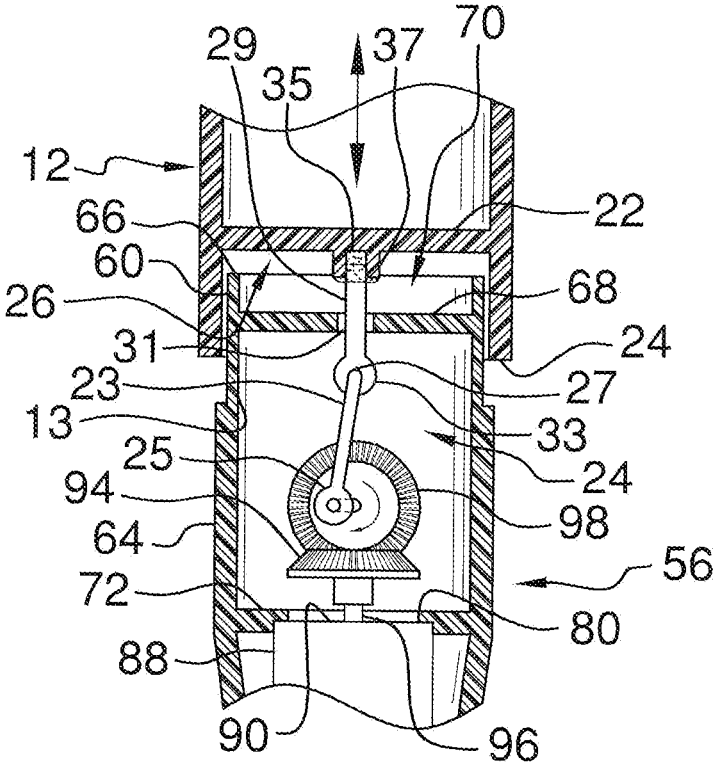
FIG. 6 is a cross sectional view taken along line 6-6 of FIG. 4 of an embodiment of the disclosure.
Figure 7:
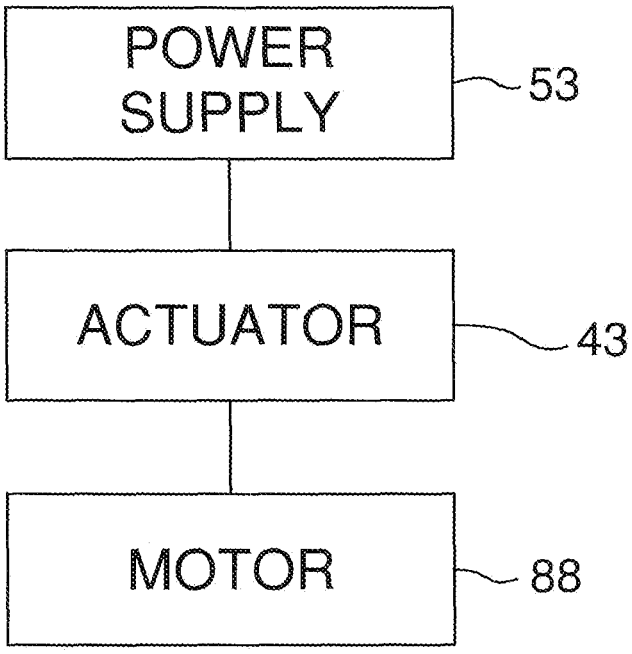
FIG. 7 is a schematic view of an embodiment of the disclosure.

With reference now to the drawings, and in particular to FIGS. 1 through 7 thereof, a new handheld shaker device embodying the principles and concepts of an embodiment of the disclosure and generally designated by the reference numeral 10 will be described.

As best illustrated in FIGS. 1 through 7, the handheld shaker assembly 10 generally comprises a cylindrical holder 12 comprising a first lip 14 coextensively coupled to and extending outwardly from an outer surface 16 of the cylindrical holder 12. The first lip 14 is positioned proximate an open top end 18 of the cylindrical holder 12 so the cylindrical holder 12 may insertably receive a container of fluid 20. The fluid may comprise a paint of any conventional design. Additionally, the container of fluid 20 may comprise an aerosol paint container of any conventional design.

The outer surface 16 of the cylindrical holder 12 comprises threads extending between the first lip 14 and the open top end 18 of the cylindrical holder 12. A bottom wall 22 of the cylindrical holder 12 is positioned upwardly from a bottom edge 24 of the cylindrical holder 12. A coupling space 26 is defined between the bottom wall 22 and the bottom edge 24 of the cylindrical holder 12. Moreover, the cylindrical holder 12 may have a length between 7.5 cm and 13 cm and a diameter between 4 cm and 7.5 cm.

An upper cap 28 is provided that comprises a second lip 30 coupled to and extending outwardly from an outer surface 32 of the upper cap 28 proximate a bottom end 34 of the upper cap 28. A container aperture 36 extends through a top side 38 and a bottom side 40 of the upper cap 28. Continuing, the upper cap 28 engages the threads on the outer surface 16 of the cylindrical holder 12 so the upper cap 28 is selectively retained on the cylindrical holder 12. The second lip 30 abuts the first lip 14 when the upper cap 28 is coupled to the cylindrical holder 12.

A tab 42 extends downwardly from the second lip 30. Continuing, the tab 42 engages a tab aperture 44 in a locking portion 46 of the first lip 14 when the upper cap 28 is coupled to the cylindrical holder 12. The upper cap 28 retains the container of fluid 20 in the cylindrical holder 12. Moreover, a dispensing portion 48 of the container of fluid 20 extends upwardly through the container aperture 36 when the upper cap 28 is coupled to the cylindrical container 20.

A disk 50 is provided that is selectively positionable within the cylindrical holder 12 so the disk 50 abuts the bottom wall 22 of the cylindrical holder 12. The disk 50 is one of a plurality of disks 50. Moreover, a selected number of the plurality of disks 50 is positionable in the cylindrical holder 12 so a bottom 52 of the container of fluid 20 abuts a top 54 of the disk 50. The selected number of disks 50 allows a variety of heights of containers of fluid 20 to be retained within the cylindrical holder 12 so the container of fluid 20 cannot freely move within the cylindrical holder 12.

A tubular housing 56 is provided that may be gripped by a user 58. A top portion 60 of an outer wall 62 of the tubular housing 56 has a thickness that is less than a thickness of a lower portion 64 of the outer wall 62 of the tubular housing 56. Additionally, the top portion 60 of the outer wall 62 of the tubular housing 56 is insertably positioned within the coupling space 26. A top edge 66 of the tubular housing 56 is positioned proximate the bottom wall 22 of the cylindrical holder 12.

A top wall 68 of the tubular housing 56 is spaced downwardly from the top edge 66 of the tubular housing 56. The top wall 68 of the tubular housing 56 defines an interior of the tubular housing 56. Moreover, an engaging space 70 is defined between the top wall 68 and the top edge 66 of said tubular housing 56. The engaging space 70 may have a height between 3 mm and 6.5 mm.

An upper medial wall 72 is positioned within the interior of the tubular housing 56. Moreover, the upper medial wall 72 is spaced downwardly from the top wall 68 of the tubular housing 56. A gear space 74 is defined between the upper medial wall 72 and the top wall 68 of the tubular housing 56. Additionally, the gear space 74 may have a height between 4 cm and 7 cm.

A lower medial wall 76 is positioned within the interior of the tubular housing 56. Additionally, the lower medial wall 76 of the tubular housing 56 is spaced downwardly from the upper medial wall 72 of the tubular housing 56. Further, a motor space 78 is defined between the upper 72 and lower 76 medial walls of the tubular housing 56. An opening 80 extends through the upper medial wall 72 of the tubular housing 56 so the motor space 78 is in fluid communication with the gear space 74. Finally, the motor space 78 may have a height between 3 cm and 6 cm.

The lower medial wall 76 also defines a power supply space 82 between the lower medial wall 76 and a bottom end 84 of the tubular housing 56. An opening 86 extends through the lower medial wall 76 so the power supply space 82 is in fluid communication with motor space 78. Continuing, the power supply space 82 may have a height between 5 cm and 8 cm. The lower portion 64 of the outer wall 62 of the tubular housing 56 has a concavely arcuate portion 66 extending between the upper medial wall 72 and the bottom end 84 of the tubular housing 56. The user 58 may grip the concavely arcuate portion 66 of the outer wall 62 of the tubular housing 56.

A motor 88 is coupled to the tubular housing 56 so the motor 88 is positioned within the motor space 78. The motor 88 extends between the upper 72 and lower 76 medial walls of the tubular housing 56. A top end 90 of the motor 88 is positioned in the opening 80 in the upper medial wall 72 of the tubular housing 56, and a bottom end 92 of the motor 88 is positioned in the opening 86 in the lower medial wall 76 of the tubular housing 56. Lastly, the motor 88 may be an electrical motor of any conventional design with an operational voltage between 3 VDC and 12 VDC.

A primary gear 94 is coupled to a shaft 96 extending between the motor 88 and the primary gear 94 so the motor selectively rotates the primary gear 94. The primary gear 94 is positioned within the gear space 74 proximate the upper medial wall 72 of the tubular housing 56. A secondary gear 98 is rotatably coupled to a shaft 11 extending between an inside surface 13 of the outer wall 62 of the tubular housing 56 and the secondary gear 98. Moreover, the secondary gear 98 is positioned within the gear space 74 such that the secondary gear 98 is oriented at a right angle with respect to the primary gear 94. The secondary gear 98 engages the primary gear 94 so the primary gear 94 rotates the secondary gear 98.

A cam shaft 15 is rotatably coupled between the secondary gear 98 and the inside surface 13 of the outer wall 62 of the tubular housing 56 so the secondary gear 98 rotates the cam shaft 15. The cam shaft 15 is oriented parallel to the top 68 and upper medial 72 walls of the tubular housing 56. Continuing, a cam portion 17 of the cam shaft 15 is positioned closer to a first end 19 of the cam shaft 15 than a second end 21 of the cam shaft 15 so the cam shaft 15 has a U-shape. The earn shaft 15 and the secondary gear 98 are each positioned proximate the primary gear 94.

A first linkage 23 is provided. A bottom end 25 of the first linkage 23 is rotatably coupled to the cam portion 17 of the cam shaft 15. An upper end 27 of the first linkage 23 is urged upwardly and downwardly when the cam shaft 15 is rotated. Moreover, the upper end 27 of the first linkage 23 has have a T-shape. Lastly, the first linkage 23 may have a length between 2 cm and 4 cm.

A second linkage 29 extends through a linkage aperture 31 extending through the top wall 68 of the tubular housing 56. A U-shaped bottom end 33 of the second linkage 29 is rotatably coupled to the T-shaped upper end 27 of the first linkage 23. Moreover, a T-shaped upper end 35 of the second linkage 29 is urged upwardly and downwardly when the cam shaft 15 is rotated. The T-shaped upper end 35 of the second linkage 29 engages a retainer 37 that is coupled to the bottom wall 22 of the cylindrical holder 12.

A groove 39 in the retainer 37 accepts the T-shaped upper end 35 of the second linkage 29. The T-shaped upper end 35 of the second linkage 29 is rotated into a retaining slot 41 in the retainer 37 so the cylindrical holder 12 is movably coupled to the tubular housing 56. The cylindrical holder 12 rapidly oscillates upwardly and downwardly when the cam shaft 15 is rotated. The oscillation of the cylindrical holder 12 mixes the container of fluid 20.

An actuator 43 is coupled to the outer wall 62 of the tubular housing 56 so the actuator 43 is selectively actuatable by the user 58. Moreover, the actuator 43 is positioned proximate the top portion 60 of the outer wall 62 of the tubular housing 56. The actuator 43 is electrically coupled to the motor 88 so the actuator 43 selectively actuates and de-actuates the motor 18. A lower cap 45 is removably coupled to the bottom end 84 of the tubular housing 56. The lower cap 45 selectively closes the power supply space 82.

A spring contact 47 is coupled to and extends upwardly from a bottom surface 49 of the lower cap 45. The spring contact 47 is one of a plurality of spring contacts 47 distributed around the lower cap 45. Additionally, a flat contact 51 is coupled to the lower medial wall 76 of the tubular housing 56. The flat contact 51 is electrically coupled between the actuator 43 and the motor 88.

A power supply 53 is coupled to the tubular housing 56 so the power supply 53 is positioned within the power supply space 82. The power supply 53 may comprise at least one 3 VDC battery 55. A negative side 57 of the battery 55 abuts the spring contact 47 so the battery 55 is selectively electrically coupled to the spring contact 47. A positive side 59 of the battery 55 abuts the flat contact 51 so the battery 55 is selectively electrically coupled to the flat contact 51. The lower cap 45 retains the power supply 53 in the power supply space 82.

In use, a selected number of the disks 50 is positioned within the cylindrical holder 12. The selected number of disks 50 is chosen so a top 61 of the container of fluid 20 abuts the upper cap 28 when the upper cap 28 is positioned on the cylindrical holder 12. The actuator 43 is actuated so the cylindrical holder 12 oscillates upwardly and downwardly to mix the container of fluid 20. The user 58 de-actuates the actuator 43 after a selected, duration of time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A handheld shaker assembly for mixing a container of fluid, said assembly comprising:

a cylindrical holder comprising a first lip coextensively coupled to and extending outwardly from an outer surface of said cylindrical holder wherein said first lip is positioned proximate an open top end of said cylindrical holder wherein said cylindrical holder is configured to insertably receive the container of fluid, said outer surface of said cylindrical holder comprising threads extending between said first lip and said open top end of said cylindrical holder, a bottom wall of said cylindrical holder being positioned upwardly from a bottom edge of said cylindrical holder wherein a coupling space is defined between said bottom wall and said bottom edge of said cylindrical holder;

an upper cap comprising a second lip coupled to and extending outwardly from an outer surface of said upper cap proximate a bottom end of said upper cap;

a container aperture extending through a top side and a bottom side of said upper cap, said upper cap engaging said threads on said outer surface of said cylindrical holder wherein said upper cap is selectively retained on said cylindrical holder wherein said upper cap retains the container of fluid in said cylindrical holder;

a tubular housing comprising a top portion of an outer wall of said tubular housing having a thickness being less than a thickness of a lower portion of said outer wall of said tubular housing wherein said top portion of said outer wall of said tubular housing is insertably positioned within said coupling space wherein said tubular housing is configured to be gripped by a user, a top wall of said tubular housing being positioned downwardly from a top edge of said tubular housing wherein an engaging space is defined between said top wall and said top edge of said tubular housing, an upper medial wall of said tubular housing being positioned downwardly from said top wall of said tubular housing wherein a gear space is defined between said upper medial wall and said top wall of said tubular housing, a lower medial wall of said tubular housing being positioned downwardly from said upper medial wall of said tubular housing wherein a motor space is defined between said upper and lower medial walls of said tubular housing, said lower medial wall defining a power supply space between said lower medial wall and a bottom end of said tubular housing;

a motor coupled to said tubular housing wherein said motor is positioned within said motor space such that said motor extends between said central and upper medial walls of said tubular housing;

a primary gear coupled to a shaft extending between said motor and said primary gear wherein said primary gear is positioned within said gear space wherein said motor rotates said primary gear;

a secondary gear rotatably coupled to an inside surface of said outer wall of said tubular housing wherein said secondary gear is positioned within said gear space such that said secondary gear is oriented at a right angle with respect to said primary gear wherein said secondary gear engages said primary gear wherein said primary gear rotates said secondary gear;

a cam shaft rotatably coupled between said secondary gear and said inside surface of said outer wall of said tubular housing wherein said cam shaft is oriented parallel to said top and upper medial walls of said tubular housing;

a first linkage comprising a bottom end of said first linkage rotatably coupled to a cam portion of said cam shaft wherein an upper end of said first linkage is urged upwardly and downwardly when said cam shaft is rotated;

a second linkage extending through a linkage aperture extending through said top wall of said tubular housing wherein a bottom end of said second linkage is rotatably coupled to said upper end of said first linkage wherein an upper end of said second linkage is urged upwardly and downwardly when said cam shaft is rotated operationally coupled to said first linkage wherein said first linkage moves said second linkage, said upper end of said second linkage engaging said bottom wall of said cylindrical holder wherein said cylindrical holder is urged upwardly and downwardly when said cam shaft is rotated wherein said cylindrical holder mixes the container of fluid;

an actuator coupled to said outer wall of said tubular housing wherein said actuator is selectively actuatable by the user, said actuator being electrically coupled to said motor wherein said actuator selectively actuates and de-actuates said motor;

a cap removably coupled to said bottom end of said tubular housing wherein said cap selectively closes said power supply space;

a spring contact coupled to a bottom surface of said cap wherein said spring contact extends upwardly from said bottom surface of said cap, said spring contact being one of a plurality of said spring contacts; and a power supply coupled to said tubular housing wherein said power supply is positioned within said power supply space, said power supply being electrically coupled to said actuator, said power supply comprising at least one battery.

* * * * *